US008486884B2

(12) United States Patent
Seebeck et al.

(10) Patent No.: US 8,486,884 B2
(45) Date of Patent: Jul. 16, 2013

(54) METHOD FOR PRODUCING GRANULAR OR POWDERY DETERGENT COMPOSITIONS

(75) Inventors: Tanja Seebeck, Bensheim (DE); Helmut Guembel, Dannenfels (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 12/088,891

(22) PCT Filed: Sep. 29, 2006

(86) PCT No.: PCT/EP2006/066868

§ 371 (c)(1), (2), (4) Date: Apr. 1, 2008

(87) PCT Pub. No.: WO2007/039554

PCT Pub. Date: Apr. 12, 2007

(65) Prior Publication Data

US 2008/0255022 A1 Oct. 16, 2008

(30) Foreign Application Priority Data

Oct. 5, 2005 (DE) ..... 10 2005 047 833

(51) Int. Cl.
*C11D 11/00* (2006.01)
*C11D 3/37* (2006.01)

(52) U.S. Cl.
USPC ..... 510/443; 510/452; 510/475; 510/476; 510/361

(58) Field of Classification Search
USPC ..... 510/443, 452, 475, 476, 361
See application file for complete search history.

(56) References Cited

U.S. PATENT DOCUMENTS

| | | | | |
|---|---|---|---|---|
| 3,676,373 | A * | 7/1972 | Paviak | 510/476 |
| 3,793,228 | A | 2/1974 | Kandler et al. | |
| 4,186,114 | A * | 1/1980 | Nakamura et al. | 510/351 |
| 4,347,168 | A * | 8/1982 | Murphy et al. | 510/452 |
| 4,478,735 | A * | 10/1984 | Yazaki et al. | 510/452 |
| 4,537,604 | A * | 8/1985 | Dawson | 51/298 |
| 5,205,960 | A * | 4/1993 | Kristopeit et al. | 510/284 |
| 5,232,622 | A * | 8/1993 | Jones et al. | 510/230 |
| 5,281,352 | A | 1/1994 | Savio et al. | |
| 5,376,288 | A * | 12/1994 | Falholt et al. | 510/301 |
| 5,595,968 | A | 1/1997 | Gopalkrishnan et al. | |
| 5,618,782 | A | 4/1997 | Gopalkrishnan et al. | |
| 5,733,861 | A | 3/1998 | Gopalkrishnan et al. | |
| 5,854,197 | A * | 12/1998 | Duccini et al. | 510/434 |
| 5,998,360 | A * | 12/1999 | Cockett et al. | 510/361 |
| 6,172,028 | B1 * | 1/2001 | Baur et al. | 510/361 |
| 6,716,808 | B1 * | 4/2004 | Rohrbaugh et al. | 510/507 |
| 2004/0058846 | A1 * | 3/2004 | Kistenmacher et al. | 510/475 |
| 2004/0072716 | A1 * | 4/2004 | Kistenmacher et al. | 510/475 |

FOREIGN PATENT DOCUMENTS

| | | |
|---|---|---|
| DE | 26 50 281 | 3/1978 |
| DE | 43 00 239 | 7/1994 |
| WO | 91 09932 | 7/1991 |
| WO | 96 17919 | 6/1996 |
| WO | 97 46657 | 12/1997 |

OTHER PUBLICATIONS

U.S. Appl. No. 12/783,726, filed May 20, 2010, Seebeck, et al.
U.S. Appl. No. 12/783,804, filed May 20, 2010, Seebeck, et al.

* cited by examiner

*Primary Examiner* — Lorna M Douyon
(74) *Attorney, Agent, or Firm* — Oblon, Spivak, McClelland, Maier & Neustadt, L.L.P.

(57) ABSTRACT

The present invention relates to a method for producing granular or pulverulent detergent compositions, comprising the production of a detergent base powder by drying an aqueous detergent slurry, which comprises adding to the slurry a copolymer which is obtained by free-radical copolymerization of (A) from 20 to 80% by weight of at least one monomer selected from the group consisting of monoethylenically unsaturated monocarboxylic acids, dicarboxylic acids and dicarboxylic anhydrides, and (B) from 20 to 80% by weight of at least one monomer selected from the group consisting of aliphatic or aromatic monoolefins.

11 Claims, No Drawings

METHOD FOR PRODUCING GRANULAR OR POWDERY DETERGENT COMPOSITIONS

The present invention relates to a process for producing granular or pulverulent detergent compositions, comprising the production of a detergent base powder by drying an aqueous detergent slurry, and also to detergent slurries and detergent compositions comprising a copolymer obtainable by free-radical copolymerization of (A) from 20 to 80% by weight of at least one monomer from the group of the monoethylenically unsaturated monocarboxylic acids, dicarboxylic acids and dicarboxylic anhydrides and (B) from 20 to 80% by weight of at least one monomer from the group of the aliphatic or aromatic monoolefins.

In the production of powder detergents or base powders for further processing to solid detergents (for example extrusion with addition of further components to give granules), up to 30 liquid or solid components, some of them in very different amounts, have to be homogenized very intensively and uniformly, which is done by slurrying in water. In the course of this, various components, for example surfactants and the zeolites used as builders, give rise to highly viscous mixtures. Since very highly concentrated slurries are desired for the subsequent spray-drying, it is necessary to use assistants which lower the viscosity of the slurries.

WO-A-91/09932 describes a process for producing granular detergent compositions in which a deflocculating polymer with a hydrophilic polymer backbone and hydrophobic side chains is added to the detergent slurry. The backbone is based on unsaturated monocarboxylic acids, dicarboxylic acids and/or alcohols as monomer units; the side chains which may comprise polyalkylene oxide blocks are bonded to the backbone via ester, ether or amide functions. In the examples, a copolymer of acrylic acid and dodecyl maleate is used.

Copolymers of acrylic acid and ethoxylated allyl ethers having a mean molecular weight $M_w$ of about 12 000 g/mol are used for this purpose in U.S. Pat. Nos. 5,595,968, 5,618,782 and 5,733,861.

Finally, WO-A-96/17919 describes copolymers of acrylic acid and maleic acid which comprise dodecyl mercaptan radicals as end groups as deflocculating agents for detergent slurries.

It was an object of the invention to enable the production of solid detergent compositions in an advantageous manner by use of viscosity-lowering polymers.

Accordingly, a process has been found for producing granular or pulverulent detergent compositions, comprising the production of a detergent base powder by drying an aqueous detergent slurry, which comprises adding to the slurry a copolymer which is obtainable by free-radical copolymerization of (A) from 20 to 80% by weight of at least one monomer from the group of the monoethylenically unsaturated monocarboxylic acids, dicarboxylic acids and dicarboxylic anhydrides and (B) from 20 to 80% by weight of at least one monomer from the group of the aliphatic or aromatic monoolefins.

Also found has been a process for lowering the viscosity of detergent slurries, which comprises adding these copolymers to the slurry.

Moreover, detergent slurries and detergent compositions which comprise these copolymers have been found.

The copolymers used in accordance with the invention comprise, as the copolymerized monomer (A), a monoethylenically unsaturated monocarboxylic acid or dicarboxylic acid or a mixture of these acids. The acids may be used in the form of their water-soluble salts, especially of the alkali metal salts such as potassium salts and in particular sodium salts, or ammonium salts; the dicarboxylic acids may also be present fully or partly in anhydride form. It will be appreciated that it is also possible to use acid mixtures.

The monomers (A) comprise preferably from 3 to 10 carbon atoms.

Specific examples of suitable monomers (A) include: acrylic acid, methacrylic acid, crotonic acid, vinylacetic acid, maleic acid, maleic anhydride, fumaric acid, citraconic acid, citraconic anhydride and itaconic acid.

Particularly preferred monomers (A) are acrylic acid, methacrylic acid and maleic acid/anhydride, very particular preference being given to maleic acid/anhydride.

The copolymers used in accordance with the invention comprise from 20 to 80% by weight, in particular from 30 to 70% by weight of monomer (A).

As the copolymerized monomer (B), the copolymers used in accordance with the invention comprise at least one aliphatic or aromatic monoolefin.

Specific examples of suitable monomers (B) are: 1-butene, isobutene, 1-pentene, 1-hexene, diisobutene (2-methyl-4,4-dimethyl-1-pentene), 1-decene, 1-dodecene, 1-tetradecene, 1-hexadecene, $C_{18}$-$C_{24}$-α-olefins such as 1-octadecene, 1-eicosene, 1-docosene and 1-tetracosene, $C_{20}$-$C_{24}$-α-olefin mixtures, 1-hexacosene, polyisobutenes having an average of 12 to 100 carbon atoms and styrene.

The copolymers used in accordance with the invention preferably comprise, as component (B), a mixture of (B1) at least one monoolefin having $\leqq 8$ carbon atoms and (B2) at least one monoolefin having $\geqq 10$ carbon atoms.

Suitable monoolefins (B1) are in particular isobutene, diisobutene and styrene. Particularly suitable monoolefins (B2) are 1-dodecene, $C_{18}$-$C_{24}$-α-olefins, $C_{20}$-$C_{24}$-α-olefin mixtures and polyisobutenes having an average of from 12 to 100 carbon atoms.

The copolymers used in accordance with the invention comprise from 20 to 80% by weight, preferably from 30 to 70% by weight of monomer (B).

Very particularly preferred copolymers used in accordance with the invention are obtainable by free-radical copolymerization of (A) from 30 to 70% by weight of maleic acid/anhydride, (B1) from 20 to 40% by weight of isobutene and (B2) from 5 to 20% by weight of a $C_{18}$-$C_{24}$-α-olefin.

The copolymers used in accordance with the invention have a mean molecular weight $M_w$ of from 1000 to 200 000 g/mol, preferably from 2000 to 50 000 g/mol (determined by gel permeation chromatography at room temperature with aqueous eluents).

Their K values are correspondingly from 10 to 150, preferably from 15 to 60 (measured at pH 7 in 1% by weight aqueous solution at 25° C.; according to H. Fikentscher, Cellulose-Chemie, vol. 13, p. 58-64 and 71-74 (1932)).

The copolymers used in accordance with the invention may be prepared by known processes.

Typically, they are obtained especially in the form of aqueous polymer solutions or dispersions which have a solids content of from 10 to 70% by weight, preferably from 25 to 60% by weight.

It is possible with the copolymers used in accordance with the invention to effectively lower the viscosity of aqueous detergent slurries, especially of the slurries which are dried to produce granular or pulverulent detergent compositions, so that even highly concentrated slurries can be handled without any problem. Thus, the slurry concentrations may be always ≧50% by weight, preferably ≧60% by weight, based on the anhydrous detergent components.

The copolymers used in accordance with the invention additionally bring about stabilization and homogenization of the slurries and prevent separations.

They are added to the slurries generally in amounts of from 0.01 to 10% by weight, preferably from 0.05 to 5% by weight and more preferably from 0.1 to 5% by weight, based on the overall mixture.

They can either be added to the overall mixture or admixed in any portions to individual detergent components, for example to the surfactants or to the builder premixes, whose solids contents may already have been raised in this way.

Inventive solid detergent formulations which comprise the polymers used in accordance with the invention advantageously have, for example, the following composition:

(a) from 0.01 to 10% by weight of at least one inventive copolymer,
(b) from 0.5 to 40% by weight of at least one nonionic, anionic and/or cationic surfactant,
(c) from 0.5 to 80% by weight of an inorganic builder,
(d) from 0 to 10% by weight of an organic cobuilder and
(e) from 0 to 60% by weight of other customary ingredients, such as standardizers, enzymes, perfume, complexing agents, corrosion inhibitors, bleaches, bleach activators, bleach catalysts, dye transfer inhibitors, graying inhibitors, soil-release polyesters, fiber and dye protection additives, silicones, dyes, bactericides, dissolution improvers and/or disintegrants, the sum of components (a) to (e) being 100% by weight.

Suitable nonionic surfactants (b) are in particular:

alkoxylated $C_8$-$C_{22}$-alcohols, such as fatty alcohol alkoxylates, oxo alcohol alkoxylates and Guerbet alcohol ethoxylates: the alkoxylation may be effected with $C_2$-$C_{20}$-alkylene oxides, preferably ethylene oxide, propylene oxide and/or butylene oxide. Block copolymers or random copolymers may be present. Per mole of alcohol, they typically contain from 2 to 50 mol, preferably from 3 to 20 mol, of at least one alkylene oxide. A preferred alkylene oxide is ethylene oxide. The alcohols preferably have from 10 to 18 carbon atoms.

alkylphenol alkoxylates, in particular alkylphenol ethoxylates, which contain $C_6$-$C_{14}$-alkyl chains and from 5 to 30 mol of alkylene oxide/mole.

alkyl polyglucosides which contain $C_8$-$C_{22}$-, preferably $C_{10}$-$C_{18}$-alkyl chains and generally from 1 to 20, preferably from 1.1 to 5, glucoside units.

N-alkylglucamides, fatty acid amide alkoxylates, fatty acid alkanolamide alkoxylates, and block copolymers of ethylene oxide, propylene oxide and/or butylene oxide.

Suitable anionic surfactants are, for example:

sulfates of (fatty) alcohols having from 8 to 22, preferably from 10 to 18, carbon atoms, in particular $C_9$-$C_{11}$-alcohol sulfates, $C_{12}$-$C_{14}$-alcohol sulfates, $C_{12}$-$C_{18}$-alcohol sulfates, lauryl sulfate, cetyl sulfate, myristyl sulfate, palmityl sulfate, stearyl sulfate and tallow fatty alcohol sulfate.

sulfated alkoxylated $C_8$-$C_{22}$-alcohols (alkyl ether sulfates): compounds of this type are prepared, for example, by first alkoxylating a $C_8$-$C_{22}$-, preferably a $C_{10}$-$C_{18}$-alcohol, for example a fatty alcohol, and then sulfating the alkoxylation product. For the alkoxylation, preference is given to using ethylene oxide.

linear $C_8$-$C_{20}$-alkylbenzenesulfonates (LAS), preferably linear $C_9$-$C_{13}$-alkylbenzene-sulfonates and -alkyltoluenesulfonates.

alkanesulfonates, in particular $C_8$-$C_{24}$-, preferably $C_{10}$-$C_{18}$-alkanesulfonates.

soaps, such as the sodium and potassium salts of $C_8$-$C_{24}$-carboxylic acids.

The anionic surfactants are added to the detergent preferably in the form of salts. Suitable salts are, for example, alkali metal ions such as sodium, potassium and lithium, and ammonium salts such as hydroxyethylammonium, di(hydroxyethyl)-ammonium and tri(hydroxyethyl)ammonium salts.

Particularly suitable cationic surfactants include:

$C_7$-$C_{25}$-alkylamines;

N,N-dimethyl-N-(hydroxy-$C_7$-$C_{25}$-alkyl)ammonium salts;

mono- and di($C_7$-$C_{25}$-alkyl)dimethylammonium compounds quaternized with alkylating agents;

ester quats, in particular quaternary esterified mono-, di- and trialkanolamines which have been esterified with $C_8$-$C_{22}$-carboxylic acids;

imidazoline quats, in particular 1-alkylimidazolinium salts of the formulae 1 or 11

I

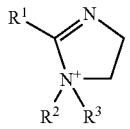

II

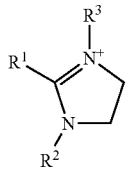

in which the variables are defined as follows:

$R^1$ is $C_1$-$C_{25}$-alkyl or $C_2$-$C_{25}$-alkenyl;

$R^2$ is $C_1$-$C_4$-alkyl or hydroxy-$C_1$-$C_4$-alkyl;

$R^3$ is $C_1$-$C_4$-alkyl, hydroxy-$C_1$-$C_4$-alkyl or an $R^1$—(CO)—X—$(CH_2)_p$— radical (X: —O— or —NH—; p: 2 or 3), where at least one $R^1$ radical is $C_7$-$C_{22}$-alkyl.

Suitable inorganic builders are in particular:

crystalline and amorphous alumosilicates having ion-exchanging properties, in particular zeolites: various types of zeolites are suitable, especially the zeolites A, X, B, P, MAP and HS in their Na form or in forms in which Na has been partly exchanged for other cations such as Li, K, Ca, Mg or ammonium.

crystalline silicates, especially disilicates and sheet silicates, for example ϵ- and β-$Na_2Si_2O_5$. The silicates may be used in the form of their alkali metal, alkaline earth metal or ammonium salts; preference is given to the sodium, lithium and magnesium silicates.

amorphous silicates, such as sodium metasilicate and amorphous disilicate.

carbonates and hydrogencarbonates: these may be used in the form of their alkali metal, alkaline earth metal or ammonium salts. Preference is given to sodium, lithium and magnesium carbonates and hydrogencarbonates, especially sodium carbonate and/or sodium hydrogencarbonate.

polyphosphates, such as pentasodium triphosphate.

Suitable organic cobuilders are in particular:

low molecular weight carboxylic acids such as citric acid, hydrophobically modified citric acid, e.g. agaric acid, malic acid, tartaric acid, gluconic acid, glutaric acid, succinic acid, imidodisuccinic acid, hydroxydisuccinic acid, oxydisuccinic acid, propanetricarboxylic acid, butanetetracarboxylic acid, cyclopentanetetra-carboxylic acid, alkyl- and alkenylsuccinic acids and aminopolycarboxylic acids, e.g. nitrilotriacetic acid, β-alaninediacetic acid, ethylenediaminetetraacetic acid, diethylenetriaminepentaacetic acid, serinediacetic acid, isoserinediacetic acid, glutaminediacetic acid, N-(2-hydroxyethyl)iminodiacetic acid, ethylenediamine-disuccinic acid and methyl- and ethylglycinediacetic acid.

oligomeric and polymeric carboxylic acids such as homopolymers of acrylic acid and aspartic acid, oligomaleic acids, copolymers of maleic acid with acrylic acid, methacrylic acid or $C_2$-$C_{22}$-olefins, e.g. isobutene or long-chain α-olefins, vinyl $C_1$-$C_8$-alkyl ethers, vinyl acetate, vinyl propionate, (meth)acrylic esters of $C_1$-$C_8$-alcohols and styrene. Preference is given to the homopolymers of acrylic acid and copolymers of acrylic acid with maleic acid. The oligomeric and polymeric carboxylic acids are used in acid form or as the sodium salt.

Suitable bleaches are, for example, adducts of hydrogen peroxide to inorganic salts, such as sodium perborate monohydrate, sodium perborate tetrahydrate and sodium carbonate perhydrate, and percarboxylic acids such as phthalimidopercaproic acid.

Suitable bleach activators are, for example, N,N,N',N'-tetraacetylethylenediamine (TAED), sodium p-nonanoyloxybenzenesulfonate and N-methylmorpholinium acetonitrile methylsulfate.

Enzymes used with preference in detergents are proteases, lipases, amylases, cellulases, oxidases and peroxidases.

Suitable dye transfer inhibitors are, for example, homopolymers, copolymers and graft polymers of 1-vinylpyrrolidone, 1-vinylimidazole and 4-vinylpyridine N-oxide. Homopolymers and copolymers of 4-vinylpyridine reacted with chloroacetic acid are also suitable as dye transfer inhibitors.

Detergent ingredients are otherwise generally known. Detailed descriptions can be found, for example, in WO-A-99/06524 and 99/04313 and in Liquid Detergents, editor: Kuo-Yann Lai, Surfactant Sci. Ser., Vol. 67, Marcel Dekker, New York, 1997, p. 272-304.

EXAMPLES

The viscosity-lowering action of the copolymer P was investigated in two detergent slurries.

The copolymer P was a copolymer of maleic anhydride, isobutene and 1-octadecene in a weight ratio of 65:26:9, which had a mean molecular weight $M_w$ of 3000 g/mol and a K value of 24 (measured at pH 7 in 1% by weight aqueous solution at 25° C.). The copolymer was used in the form of a 40% by weight aqueous solution.

The two detergent slurries were prepared as follows:

In a 500 ml heatable jacketed stainless steel vessel, two different detergent slurries were produced with stirring. To this end, the liquid components were initially heated at 50° C. for 10 min with stirring. The stirrer used had a torque recorder. Within 4 min, the solid components mixed beforehand were metered in uniformly, in the course of which the slurry continued to be stirred at 150 rpm. After the addition had ended, the slurry continued to be stirred at constant rotational speed while determining the torque.

The torque expresses the force which is required to stir the slurry at constant rotational speed. The lower the torque, the lower the viscosity of the detergent slurry.

Table 1 lists the compositions of the detergent slurries. The amounts reported relate to feedstocks in anhydrous form, i.e. without water fractions or water of crystallization, which are present in the overall water content.

Table 2 compiles the torques obtained after 30 min in each case. For comparison, the results obtained without polymer addition are also listed.

The result nd means that the viscosity of the slurry was very high and the torque was no longer determinable.

TABLE 1

Composition of the detergent slurries

| Feedstock | Slurry 1 [% by wt.] | Slurry 2 [% by wt.] |
|---|---|---|
| Dodecylbenzenesulfonate, Na salt | 14.1 | 17.2 |
| $C_{13/15}$ oxo alcohol · 7 EO | 7.6 | 6.2 |
| Zeolite A | 21.7 | — |
| Sodium carbonate | 16.3 | 7.8 |
| Sodium metasilicate | 10.9 | — |
| Sodium tripolyphosphate | — | 15.6 |
| Sodium sulfate | — | 27.3 |
| Copolymer P | 1.1 | 1.8 |
| Total water content | 28.3 | 24.1 |
| Total solids content | 71.7 | 75.9 |

TABLE 2

Determination of the torque

| | Torque [Ncm] after 30 min | |
|---|---|---|
| | Slurry 1 | Slurry 2 |
| with copolymer P | 12 | 28 |
| without copolymer P | nd | nd |

What is claimed is:

1. A process for producing granular or pulverulent detergent compositions, comprising producing a detergent base powder by drying an aqueous detergent slurry, said aqueous detergent slurry comprising a copolymer which is obtained by free-radical copolymerization of (A) from 20 to 80% by weight of at least one monomer selected from the group consisting of a monoethylenically unsaturated monocarboxylic acid, a dicarboxylic acid and a dicarboxylic anhydride; and (B) from 20 to 80% by weight of a mixture of (B1) at least one monoolefin having 8 or less carbon atoms and (B2) at least one monoolefin having 10 or more carbon atoms; and detergent components comprising a surfactant and a builder, wherein said aqueous detergent slurry does not comprise a further viscosity-lowering assistant.

2. The process according to claim 1, wherein the monomer (A) comprises at least one selected from the group consisting of maleic acid, maleic anhydride and acrylic acid.

3. The process according to claim 1, wherein the monomer (B) comprises at least one selected from the group consisting of isobutene, diisobutene, 1-dodecene, a $C_{18}$-$C_{24}$-α-olefin, a $C_{20}$-$C_{24}$-α-olefin mixture, a polyisobutene having an average of from 12 to 100 carbon atoms, and styrene.

4. The process according to claim 1, wherein the copolymer is obtained by free-radical copolymerization of (A) from 30 to 70% by weight of maleic acid or maleic anhydride, (B1) from 20 to 40% by weight of isobutene, and (B2) from 5 to 20% by weight of a $C_{18}$-$C_{24}$-α-olefin.

5. The process according to claim 4, wherein the copolymer has a mean molecular weight of approximately 3000 g/mol.

6. The process according to claim 1, wherein the copolymer has a K value of 15 to 60.

7. The process according to claim 1, wherein (A) is maleic anhydride, (B1) is isobutene, and (B2) is 1-octadecene.

8. A process comprising:

producing a copolymer by free-radical copolymerization of (A) from 20 to 80% by weight of at least one monomer selected from the group consisting of a monoethylenically unsaturated monocarboxylic acid, a dicarboxylic acid and a dicarboxylic anhydride; and (B) from 20 to 80% by weight of a mixture of (B1) at least one monoolefin having 8 or less carbon atoms and (B2) at least one monoolefin having 10 or more carbon atoms; and producing a detergent base powder by drying an aqueous detergent slurry comprising said copolymer produced by free-radical copolymerization and detergent components comprising a surfactant and a builder, wherein said aqueous detergent slurry does not comprise a further viscosity-lowering assistant.

9. The process according to claim 8, wherein the monomer (A) comprises at least one selected from the group consisting of maleic acid, maleic anhydride and acrylic acid.

10. The process according to claim 8, wherein the monomer (B) comprises at least one selected from the group consisting of isobutene, diisobutene, 1-dodecene, a $C_{18}$-$C_{24}$-α-olefin, a $C_{20}$-$C_{24}$-α-olefin mixture, a polyisobutene having an average of from 12 to 100 carbon atoms, and styrene.

11. The process according to claim 8, wherein the copolymer is produced by free-radical copolymerization of (A) from 30 to 70% by weight of maleic acid or maleic anhydride, (B1) from 20 to 40% by weight of isobutene, and (B2) from 5 to 20% by weight of a $C_{18}$-$C_{24}$-α-olefin.

* * * * *